United States Patent [19]

Milocco

[11] Patent Number: 4,741,353

[45] Date of Patent: May 3, 1988

[54] WASHING MACHINE WITH IMPROVED LIQUID FLOW DISTRIBUTING VALVE

[75] Inventor: Claudio Milocco, Pordenone, Italy

[73] Assignee: Industrie Zanussi, S.p.A., Pordenone, Italy

[21] Appl. No.: 21,484

[22] Filed: Mar. 4, 1987

[30] Foreign Application Priority Data

Mar. 19, 1986 [IT] Italy ..... 45711 A/86

[51] Int. Cl.[4] ..... G05D 7/03; F16K 15/04

[52] U.S. Cl. ..... 137/119; 134/178; 134/191; 137/624.11

[58] Field of Search ..... 137/119, 513.7, 624.11; 134/191, 178; 415/152 A, 146

[56] References Cited

U.S. PATENT DOCUMENTS

| | | | |
|---|---|---|---|
| 2,703,582 | 3/1955 | Stepanian | 137/513.7 |
| 3,224,458 | 12/1965 | Davis | 137/119 |
| 3,797,509 | 3/1974 | Fukuzawa et al. | 134/178 |
| 3,868,835 | 3/1975 | Todd-Reeve | 134/191 |
| 4,653,977 | 3/1987 | Fries | 415/146 X |

FOREIGN PATENT DOCUMENTS

21702 A/81 5/1981 Italy .

*Primary Examiner*—Martin P. Schwadron
*Assistant Examiner*—Stephen M. Hepperle
*Attorney, Agent, or Firm*—Wenderoth, Lind & Ponack

[57] ABSTRACT

A washing machine assembly includes first and second liquid ducts having respective inlets and outlets. The first duct has an interior volume greater than the second duct, and the outlet of the first duct is at a level higher than the outlet of the second duct. A pump pumps liquid to the ducts, and a valve controls the flow of liquid from the pump to the inlets of the first or second ducts. The valve includes a housing having an inlet connected to the delivery side of the pump and first and second outlets connected respectively to the inlets of the first and second ducts. A valve closing element within the housing is movable from a stable first unblocking position spaced from and aligned with the first outlet to a first blocking position closing the first outlet, such that the pumped liquid flows to the second duct. At the same time, a bypass allows some pumped liquid to bypass the closing element into the first duct. Thereafter, when operation of the pump is stopped, the bypassed liquid forces the closing element away from the stable unblocking position thereof to an unstable second unblocking position spaced from and aligned with the second outlet. The bypass is calibrated such that the liquid flowing back into the housing from the first duct will maintain the closing element in the unstable unblocking position for a predetermined time period, after which the closing element will return to the stable unblocking position.

7 Claims, 1 Drawing Sheet

WASHING MACHINE WITH IMPROVED LIQUID FLOW DISTRIBUTING VALVE

BACKGROUND OF THE INVENTION

The present invention relates to an automatic washing machine, more particularly to a dishwashing machine, of the type provided with a valve for distributing the flow of a circulating liquid within the hydraulic circuit of the washing machine.

In dishwashing machines in particular, a pump circulates the washing liquid within the machine and is capable of feeding two sprinkling vanes disposed at different heights within the washing machine. Thus, the delivery side of the circulation pump branches into two different ducts, each of which is connected to a respective sprinkling vane. In order to reduce the size of the pump motor as well as the size of the hydraulic circuit thereof, and further to deaden noise resulting from the impact of wash jets against dishes placed in the washing machine, it is preferable that the sprinkling vanes be fed alternately, rather than simultaneously.

Accordingly, it has been proposed, for example as disclosed in Italian patent application No. 21702 A/81 filed May 14, 1981 in the name of Industrie Candy S.p.A., to provide deflector means capable of connecting alternately the delivery side of the circulation pump to the different sprinkling vanes of a dishwashing machine. However, these deflector means are operated by the programmer of the washing machine by means of electromechanical devices or the like. This undesirably complicates the structure of the washing machine and deleteriously effects the reliability thereof.

These drawbacks can be avoided to a large extent by an arrangement as described in U.S. Pat. No. 3,868,835, wherein the circulation pump of the dishwashing machine is connected to two sprinkling vanes via a distributing valve having a closing element of the bistable type. In other words, when the pump is inoperative, the valve closing element is capable of leaning by gravity indiscriminately on a first valve seat or a second valve seat. The circulation pump is operated by the programmer of the washing machine intermittently and the valve seats, substantially ω-shaped, are positioned beneath two associated outlet ducts of the valve. Thus, during alternate operating phases of the pump the valve closing element obstructs alternately one or the other of the outlet ducts of the valve, while during shut-off or nonoperating intervals of the pump the valve element is placed alternately by gravity on the first or second valve seats. Advantageously, this distributing valve is operated directly by hydraulic pressure and by gravity, so that it is not necessary to provide electromechanical driving elements or the like. However, accurate operation and functioning of this valve is difficult to achieve. Thus, this valve is sensitive to the presence of dirt particles in the liquid flow which, even if deposited in small quantities in the areas of the valve seats, easily can prevent the closing element from operating properly.

SUMMARY OF THE INVENTION

It is a primary object of the present invention to provide a washing machine with an improved liquid flow distributing valve which is capable of distributing among various outlet ducts a flow of liquid, whereby it is possible to overcome the above and other prior art disadvantages.

It is a more specific object of the present invention to provide a washing machine with such an improved liquid flow distributing valve which is highly reliable and accurate, which avoids the problems of dirt deposition and which avoids the need for the provision of electromechanical control elements or the like.

These objects are achieved in accordance with the present invention by the provision of a washing machine assembly of the type including first and second liquid ducts having respective inlets and outlets, the first duct having an interior volume greater than the second duct and the outlet of the first duct being at a level higher than the outlet of the second duct, pump means for pumping liquid to the ducts, and valve means for controlling the flow of the liquid from the pump means to the inlets of the first or second ducts. Specifically, in accordance with the present invention the valve means includes a valve housing having an inlet connected to the delivery side of the pump means and at least first and second outlets connected respectively to the inlets of the first and second ducts. A valve closing element is positioned within the housing and is movable therein between a stable first unblocking position spaced from and aligned with the first outlet, an unstable second unblocking position spaced from and aligned with the second outlet, a first blocking position closing the first outlet, and a second blocking position closing the second outlet, with the unstable second unblocking position being at a level higher than the stable first unblocking position. With the closing element in the first or second unblocking positions, operation of the pump means to pump liquid through the valve means causes the closing element to be moved by the pumped liquid to the first or second blocking positions, respectively, thereby enabling the pump means to pump liquid to the second or first ducts, respectively. When the pump means is stopped, the closing element tends to fall by gravity away from the first or second blocking positions respectively. Bypass means is provided for, when the closing element is in the first blocking position, allowing some of the pumped liquid to bypass the closing element into the first duct, whereby when operation of the pump means is stopped the bypassed liquid in the first duct falls by gravity from the first duct and moves the closing element away from the stable first unblocking position to the unstable second blocking position. After all of the bypassed liquid has fallen from the first duct, then the closing element is allowed to move by gravity from the unstable second unblocking position to the stable first unblocking position. The bypass means is calibrated to provide a supply of the bypassed liquid into the first duct during a first operating phase of the pump means sufficient to, upon stopping of the first operating phase, maintain the closing element in the unstable second unblocking position for a predetermined time period. Thus, when a second operating phase of the pump means is started before the end of the predetermined time period, the closing element is caused to be moved by the pumped liquid from the unstable second unblocking position to the second blocking position. Similarly, when the second operating phase of the pump means is started after the end of the predetermined time period, the closing element is allowed to move by gravity from the unstable second unblocking position to the stable first unblocking position, and the closing element is caused to be moved by the pumped liquid from the stable first unblocking position to the first blocking position. By the above features of the present invention it is not necessary to provide any electromechanical control means for controlling the liquid flow distributing valve.

In accordance with a further feature of the present invention guide means is positioned within the valve housing to guide movement of the closing element from the unstable second unblocking position to the stable first unblocking position. Such guide means may comprise guide members, for example in the form of ribs, inclined downwardly from the unstable second blocking position to the stable first unblocking position.

In accordance with a further feature of the present invention, the bypass means may be in the form of a passage of reduced size bypassing the closing element in the first blocking position thereof. Alternatively, the bypass means may be achieved by an irregularly formed valve seat for the valve closing element in the first blocking position thereof, such that the bypassed liquid is allowed to flow through a space between the closing element and such valve seat.

In accordance with still a further feature of the present invention, the programmer means for controlling the operation of the washing machine controls the operation of the pump means to achieve a predetermined programmed operation of the valve. Particularly, it is contemplated in accordance with the present invention that the programmer controls the shut-down phases of the pump between the operating phases thereof to be alternately shorter and longer than the predetermined time period, thereby causing alternate distribution of the pumped liquid to the first and second ducts.

BRIEF DESCRIPTION OF THE DRAWINGS

Other objects, features and advantages of the present invention will be apparent from the following detailed description of a non-limiting example of the present invention, with reference to the accompanying drawings, wherein.

DETAILED DESCRIPTION OF THE INVENTION

Figure 1:
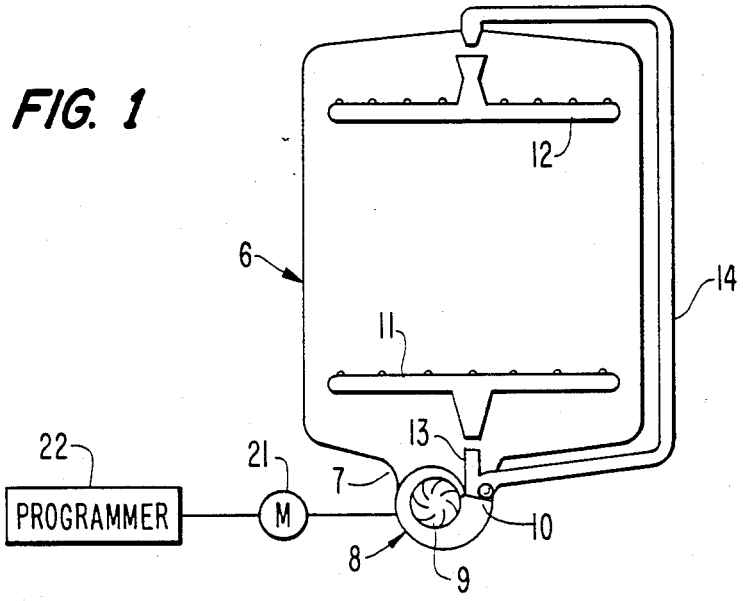
FIG. 1 is a schematic view illustrating the principle parts of a washing machine incorporating the present invention.

With reference to FIG. 1, a washing machine embodying the present invention is shown in the form of a dishwashing machine mainly including a wash tub 6 through which washing liquid is pumped by means of a circulation pump 8 having an impeller 9 driven by a motor 21, the operation of which is controlled by a programmer 22. At the bottom of wash tub 9 is a sump 7 for collecting washing liquid and which leads to the suction side of pump 8. The delivery side 10 of pump 8 feeds a plurality of sprinkling vanes for spraying washing liquid jets onto articles to be washed and supported in respective baskets (not shown) located at various heights within tub 6. FIG. 1 illustrates two sprinkling vanes 11, 12, but it is to be understood that more than two sprinkling vanes could be provided, as would be understood by one skilled in the art. More particularly, delivery side 10 of pump 8 is connected to sprinkling vane 12 via a first duct 14 and to sprinkling vane 11 via a second duct 13. It will be apparent that the interior volume of first duct 14 is greater than the interior volume of duct 13 and that the outlet of first duct 14 is at a level substantially higher than the outlet of second duct 13.

The supply of pumped liquid from pump 8 to ducts 14, 13 is controlled by a flow distributing valve 15, the operation of which is shown from a consideration of FIGS. 2 through 5. Thus, the valve 15 includes a housing having an inlet connected to the delivery side 10 of pump 8 and first and second outlets 16, 17 connected respectively to the inlets of first and second ducts 14, 13. Within the housing of valve 15 is at least one closing element 18, preferably in the form of a spherical body made, for example, of any suitable rustproof material having a specific weight greater than that of the washing liquid which is circulated through the washing machine by pump 8.

Figure 2:
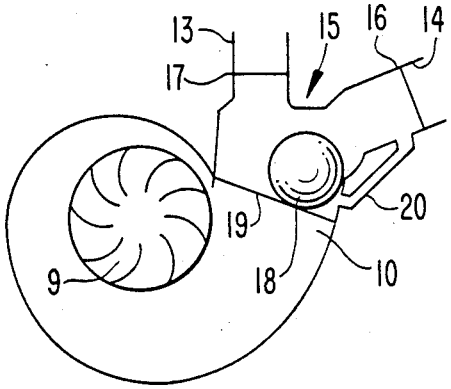
FIGS. 2 through 5 are enlarged schematic views illustrating the improved valve of the present invention in different operating positions thereof.

Normally, that is to say when pump 8 is idle, closing element 18 moves by its own weight, i.e. gravity, to a stable first unblocking position, shown in FIG. 2, spaced from and aligned with first outlet 16. When pump 8 first is operated, the washing liquid pumped through the valve lifts the closing element 18 from the position shown in FIG. 2 to the position shown in FIG. 3, i.e. a first blocking position closing first outlet 16. As a result, the washing liquid is pumped by pump 8 through outlet 17 and duct 13 to the sprinkling vane 11. At the same time however, some of the washing liquid is allowed to bypass the closing element 18 in the first blocking position shown in FIG. 3. Thus, bypass passage 20 bypasses the closed valve in this position to enable some pumped liquid into first duct 14. Bypass passage 20 could be replaced by any other arrangement to provide the same function, as would be understood by one skilled in the art. Thus, the valve seat against which closing element seats in the position of FIG. 3 could be made irregular to allow the bypass fluid flow.

Figure 3:
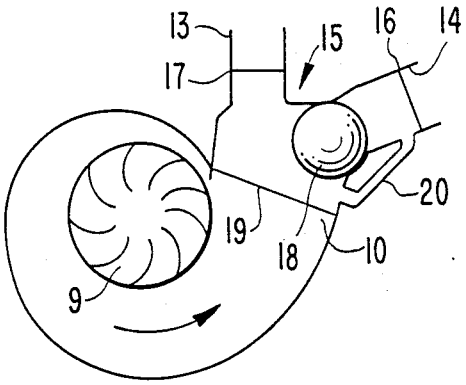

Thereafter, when operation of pump 8 is stopped, the closing element 18 tends to fall by gravity away from the blocking position of FIG. 3. At the same time however, the liquid previously filling ducts 13 and 14 falls by gravity back into the housing. The quantity of liquid contained in duct 13 is negligible. However, the liquid contained in duct 14, which previously was passed thereto through bypass passage 20, exerts on closing element 18 a substantial hydrostatic pressure sufficient to force closing element 18 to an unstable second unblocking position shown in FIG. 4 whereat the closing element is spaced from and aligned with outlet 17. Guide elements 19, for example in the form of ribs formed integrally with the valve housing, or separately therefrom, are inclined downwardly from a position beneath outlet 17 to a position beneath outlet 16. The liquid from duct 14 acts on closing element 18 to slide the closing element upwardly along guides 19 to the unstable position shown in FIG. 4. After all of the liquid falls from duct 14, then it will be apparent that closing element 18 will slide along guides 19 to return to the stable first unblocking position shown in FIG. 2. However, if pump 8 again is operated before all of the liquid falls from duct 18, i.e. with the closing element 18 still maintained in the position shown in FIG. 4, then the force of the liquid pumped by pump 8 will move closing element 18 from the unstable unblocking position shown in FIG. 4 to the blocking position shown in FIG. 5, i.e. blocking outlet 17 and duct 13. Thus, the pumped liquid will flow through outlet 16 into duct 14 and sprinkling vane 12.

Figure 4:
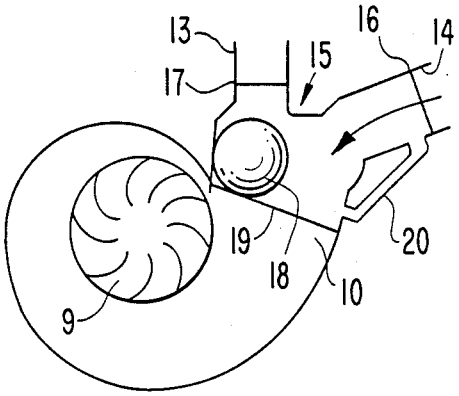
Figure 5:
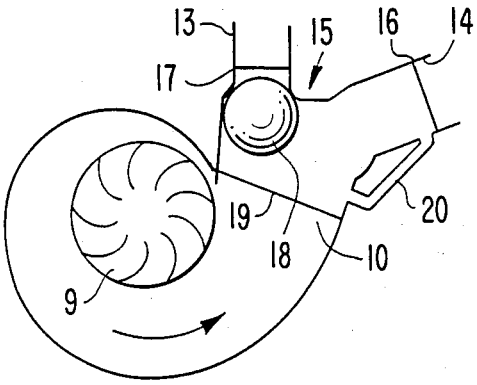

The bypass 20 is calibrated to provide a supply of bypassed water into first duct 14 during a first operating phase of pump 8 which is sufficient to, upon stopping the first operating phase of the pump, maintain closing element 18 in the unstable unblocking position shown in FIG. 4 for a predetermined period of time. Thus, when a second operating phase of pump 8 is started before the end of such predetermined time period, the closing element will be moved by the pumped liquid to the second blocking position shown in FIG. 5. However, when the second operating phase of pump 8 is started after the end of such predetermined time period, then the closing element will be allowed to slide by gravity along guides 19 to the stable first unblocking position shown in FIG. 2, whereafter when the second operating phase of the pump is started, the closing element 18 again will be moved to the first blocking position shown in FIG. 3. One skilled in the art readily would understand how to calibrate the size of the bypass in relation to the volume of duct 14 and to the capacity of pump 8.

Preferably, circulation pump 8 is capable of being operated intermittently by programmer 22 such that the shut-down phases of the pump between the operating phases thereof are alternately shorter and longer than the predetermined time period, thereby achieving alternate supply of the liquid to sprinkling vanes 12 and 11. Thus, it is contemplated that programmer 22 be an electronic circuit of known type. When the predetermined time period achieved by calibration of bypass 20 is sufficient to maintain closing element 18 in the position of FIG. 4 for, for example, 1.5 seconds, then programmer 22 could control the operation of pump 8 to achieve shut-down phases thereof alternately of, for example, 0.5 seconds and 2.0 seconds. Consequently, the pump would alternately feed sprinkling vanes 11 and 12.

It will be understood however that by appropriately varying the duration of the shut-down phases of the pump it is possible to correspondingly vary the succession of phases of feeding of liquid to vanes 11, 12, or to only one of them, in any desired varying sequence.

In any case, the operation of the distributing valve of the present invention is reliable and accurate since it is of the monostable type due to the fact that closing element 18 has a single, predetermined stable rest position.

It is to be understood that although the present invention has been described and illustrated with respect to preferred features thereof, many modifications and changes may be made to the specifically described and illustrated features without departing from the scope of the present invention, as would be understood by one skilled in the art. For example, the machine may be a washing machine of the type that recirculates the washing liquid, and valve 15 could be used to control selectively the recirculation and discharge of the liquid. Furthermore, closing element 18 can be shaped differently than spherically as illustrated. Still further, the housing of valve 15 preferably may be formed as a single piece with the volute casing of pump 8.

I claim:

1. In a washing machine assembly including first and second liquid ducts having respective inlets and outlets, said first duct having an interior volume greater than said second duct and said outlet of said first duct being at a level higher than said outlet of said second duct, pump means for pumping liquid to said ducts, and valve means for controlling the flow of liquid from said pump means to said inlets of said first or second ducts, the improvement wherein said valve means comprises:

a valve housing having an inlet connected to the delivery side of said pump means and first and second outlets connected respectively to said inlets of said first and second ducts;

a weight-biased valve closing element within said housing and movable therein between a stable first unblocking position spaced from and aligned with said first outlet, an unstable second unblocking position spaced from and aligned with said second outlet, a first blocking position closing said first outlet, and a second blocking position closing said second outlet, said unstable second unblocking position being at a level higher than said stable first unblocking position;

whereby with said closing element in said first or second unblocking positions, starting of said pump means to pump liquid through said valve means causes said closing element to be moved by the pumped liquid to said first or second blocking positions, respectively, thereby enabling said pump means to pump liquid to said second or first ducts, respectively, and whereby when operation of said pump means is stopped said closing element tends to fall by gravity away from said first or second blocking positions, respectively;

guide means for guiding movement of said closing element from said unstable second unblocking position to said stable first unblocking position;

bypass means for, when said closing element is in said first blocking position, allowing some pumped liquid to bypass said closing element into said first duct, whereby when operation of said pump means is stopped said bypassed liquid in said first duct falls by gravity from said first duct and moves said closing element to said unstable second unblocking position, and whereby after all of said bypassed liquid has fallen from said first duct said closing element moves by gravity along said guide means from said unstable second unblocking position to said stable first unblocking position; and said bypass means being calibrated to provide a supply of said bypassed water into said first duct during a first operating phase of said pump means sufficient to, upon stopping of said first operating phase, maintain said closing element in said unstable second unblocking position for a predetermined time period, whereby starting a second operating phase of said pump means before the end of said predetermined time period causes said closing element to be moved by the pumped liquid from said unstable second unblocking position to said second blocking position, and starting said second operating phase of said pump means after the end of said predetermined time period allows said closing element to move by gravity along said guide means from said unstable second unblocking position to said stable first unblocking position and then causes said closing element to be moved by the pumped liquid from said stable first unblocking position to said first blocking position.

2. The improvement claimed in claim 1, wherein said guide means comprise guide members inclined downwardly from said unstable second unblocking position to said stable first unblocking position.

3. The improvement claimed in claim 1, wherein said bypass means comprises a passage bypassing said closing element in said first blocking position thereof.

4. The improvement claimed in claim 1, further comprising programmer means for controlling operation of said pump means.

5. The improvement claimed in claim 4, wherein said programmer means controls shut-down phases of said pump means between said operating phases thereof to be alternately shorter and longer than said predetermined time period.

6. The improvement claimed in claim 1, wherein said closing element is spherical shaped and rolls along said guide means from said unstable second unblocking position to said stable first unblocking position.

7. The improvement claimed in claim 1, wherein said stable first unblocking position is located substantially vertically below said first outlet, and said unstable second unblocking position is located substantially vertically below said second outlet.

* * * * *